US010105748B2

(12) United States Patent
Denkmann et al.

(10) Patent No.: US 10,105,748 B2
(45) Date of Patent: Oct. 23, 2018

(54) METHOD FOR PRODUCING A STRIP FOR PACKAGING PURPOSES

(75) Inventors: Volker Denkmann, Kempen (DE); Wolf Oetting, San Jose, CA (US); Andreas Siemen, Jüchen (DE); Wilhelm Schenkel, Grevenbroich (DE); Boris Kasper, Haan (DE)

(73) Assignee: Hydro Aluminium Deutschland GmbH, Bonn (DE)

( * ) Notice: Subject to any disclaimer, the term of this patent is extended or adjusted under 35 U.S.C. 154(b) by 1860 days.

(21) Appl. No.: 12/988,369

(22) PCT Filed: Apr. 17, 2009

(86) PCT No.: PCT/EP2009/054613
§ 371 (c)(1),
(2), (4) Date: Apr. 8, 2011

(87) PCT Pub. No.: WO2009/127730
PCT Pub. Date: Oct. 22, 2009

(65) Prior Publication Data

US 2011/0183154 A1 Jul. 28, 2011

(30) Foreign Application Priority Data

Apr. 18, 2008 (DE) ..... 10 2008 019 768

(51) Int. Cl.
*B21B 1/22* (2006.01)
*B21H 8/00* (2006.01)
*B21B 3/00* (2006.01)

(52) U.S. Cl.
CPC ..... *B21H 8/005* (2013.01); *B21B 1/227* (2013.01); *B21B 2003/001* (2013.01); *Y10T 428/12389* (2015.01)

(58) Field of Classification Search
CPC .... B21B 1/227; B21B 2001/221; B21H 8/005
(Continued)

(56) References Cited

U.S. PATENT DOCUMENTS 1,807,141 A 5/1931 Wood
2,277,725 A * 3/1942 Smith et al. ..... 29/17.2
(Continued)

FOREIGN PATENT DOCUMENTS

CN 2399123 Y 10/2010
DE 4211197 10/1993
(Continued)

OTHER PUBLICATIONS

Translation of JP 5-57303A, Mar. 9, 1993.*
(Continued)

*Primary Examiner* — Edward Tolan
(74) *Attorney, Agent, or Firm* — Reinhart Boerner Van Deuren P.C.

(57) ABSTRACT

A method for producing a strip consisting of aluminum or an aluminum alloy for packaging purposes, in particular for cans, can lids or can closures, which provides an individualized aluminum strip for packaging purposes, with which decorative or identification elements can be reliably embossed without additional production steps being required, for example at the producer of the packaging means, is achieved in that decorative or other identification elements are embossed into the strip in the last rolling pass of cold rolling and in that the strip thickness is greater in the area of the decorative and identification elements than in the remaining areas of the strip.

10 Claims, 2 Drawing Sheets

(58) Field of Classification Search
USPC ..... 72/196, 197, 198, 199, 226, 234, 242.4, 72/366.2; 101/22, 23
See application file for complete search history.

(56) References Cited

U.S. PATENT DOCUMENTS

| | | | | | |
|---|---|---|---|---|---|
| 2,639,660 | A | * | 5/1953 | Sunderhauf et al. | 101/23 |
| 2,757,372 | A | * | 7/1956 | Chambon | 101/32 |
| 3,245,851 | A | * | 4/1966 | Lloyd-Lucas | 29/527.2 |
| 3,335,592 | A | * | 8/1967 | Woodling | 72/196 |
| 3,839,893 | A | * | 10/1974 | Appel et al. | 72/197 |
| 4,347,722 | A | * | 9/1982 | Ulam | 72/63 |
| 4,725,111 | A | | 2/1988 | Weitzen et al. | |
| 4,996,113 | A | | 2/1991 | Hector et al. | |
| 5,007,271 | A | * | 4/1991 | Boegli | 72/196 |
| 5,115,660 | A | * | 5/1992 | Kurobe et al. | 72/197 |
| 5,508,119 | A | | 4/1996 | Sheu et al. | |
| 5,537,851 | A | | 7/1996 | Sheu et al. | |
| 5,799,523 | A | | 9/1998 | Seidel et al. | |
| 6,006,415 | A | | 12/1999 | Schaefer et al. | |
| 6,187,455 | B1 | | 2/2001 | Eschauzier | |
| 6,453,709 | B2 | * | 9/2002 | Leroux et al. | 72/39 |
| 6,490,403 | B2 | | 12/2002 | Bartenbach et al. | |
| 6,925,711 | B2 | * | 8/2005 | Kilmer et al. | 29/890.053 |
| 7,094,502 | B2 | | 8/2006 | Schaefer et al. | |
| 7,147,453 | B2 | * | 12/2006 | Boegli | 425/363 |
| 7,201,850 | B2 | | 4/2007 | Kawanishi et al. | |
| 7,571,542 | B2 | * | 8/2009 | Nishino et al. | 29/895.3 |
| 8,347,684 | B2 | * | 1/2013 | Coderre | 72/197 |
| 2002/0148269 | A1 | * | 10/2002 | Ruck et al. | 72/197 |
| 2005/0000262 | A1 | * | 1/2005 | Schreiber et al. | 72/197 |
| 2006/0123867 | A1 | * | 6/2006 | Ball et al. | 72/197 |

FOREIGN PATENT DOCUMENTS

| | | | | | |
|---|---|---|---|---|---|
| EP | 1362653 | | | 11/2003 | |
| JP | S59-094505 | | | 5/1984 | |
| JP | S64-071502 | A | | 3/1989 | |
| JP | 03005002 | A | | 1/1991 | |
| JP | 3-114601 | | * | 5/1991 | B21B 1/22 |
| JP | H04-220104 | A | | 8/1992 | |
| JP | 05057303 | A | | 3/1993 | |
| JP | 06210306 | A | | 8/1994 | |
| JP | 2000288601 | A | | 10/2000 | |
| JP | 2001212602 | A | | 8/2001 | |
| JP | 2002346605 | A | | 12/2002 | |
| JP | 2004122184 | A | | 4/2004 | |
| JP | 2004-298938 | | | 10/2004 | |
| JP | 2005-330197 | | | 12/2005 | |
| WO | WO 03/013752 | A1 | | 2/2003 | |
| WO | 2006/058424 | | | 6/2006 | |

OTHER PUBLICATIONS

International Search Report for International Application No. PCT/EP2009/054613, Oct. 2009.

Novelis, Novelis Europe—Automotive, Painted & Specialties 2007 Innovation Days, New Bright Surface Developments, presentation, Jun. 12-13, 2007, 12 pages, Sierre, Switzerland.

Novelis, Aluminiumkarosseriebleche, book, 2007, 3 pages, München, Germany.

J. A. Hunter et al., Balancing Conflicting Property Requirements in the Development of High Performance AA6016 Automotive Closure Sheet, article, 2000, 7 pages, Alcan International Limited et al., Banbury, United Kingdom.

Novelis, Novelis Tread & Bright Tread Aluminum Sheet/Plate, article, 2008, 2 pages, Cleveland, Ohio.

John G. Lenard, The effect of roll roughness on the rolling parameters during cold rolling of an aluminum alloy, Journal of Materials Processing Technology, Mar. 23, 2004, 10 pages, Elsevier, Department of Mechanical Engineering, University of Waterloo, Waterloo, Ontario, Canada.

Svetlana SavićŠević et al., Biopolymer holographic diffraction gratings, ScienceDirect, Optical Materials, Jul. 19, 2007, 3 pages, Elsevier, Institute of Physics, Zemun, Belgrade, Serbia.

* cited by examiner

METHOD FOR PRODUCING A STRIP FOR PACKAGING PURPOSES

CROSS-REFERENCE TO RELATED APPLICATIONS

This application is a National Phase Application of International Patent Application No. PCT/EP2009/054613, filed on Apr. 17, 2009, which claims the benefit and priority to German Patent Application No. DE 10 2008 019 768.8-14 filed on Apr. 18, 2008, which is owned by the assignee of the instant application. The disclosure of each of these applications is incorporated herein by reference in its entirety.

FIELD OF THE INVENTION

The invention relates to a method for producing a strip consisting of aluminum or an aluminum alloy, in particular for packaging purposes, preferably for producing cans, can lids or can closures. Furthermore, the invention relates to a strip, produced according to the method according to the invention, in particular for packaging purposes.

BACKGROUND

When producing packaging, for example for foodstuffs, individualized packaging is increasingly desired. This individualization is intended to result in identifying the packaging more effectively with the associated product name of the producer. This individualization increasingly also relates to packaging consisting of aluminum strips. An example of such packaging is a beverage can. Individualizing the packaging can, for example, be achieved via an imprint which is applied by the producer of the packaging means. Moreover, it is possible to emboss patterns, symbols or other identification elements into, for example, an aluminum strip, directly before producing the packaging means. Embossing dies or embossing means, for example, have to be provided at the aluminum strip machining plant for this purpose. To avoid this, it is known from the international patent application WO 2006/058424 A1, to already emboss the aluminum strip during manufacture by means of a finishing roll. In order, on the one hand, to emboss an identification element, for example a logo, into the aluminum strip, it is proposed in the above-mentioned international patent application that the embossing rolls should only bring about plastic deformation of the areas of the strip provided with an identification element. For this purpose, the embossing rolls have areas sticking out of the roll surface which are used to emboss, for example, a logo. The remaining strip areas, i.e. the strip areas between the logos, are not, in contrast, plastically deformed during the embossing process.

The problem with this method now is that flawless embossing of the identification elements, patterns or logos requires particularly meticulous setting of the embossing rolls. It is, therefore, difficult to guarantee a reliable process for embossing the logos into the strip.

SUMMARY OF THE INVENTION

In general, an aspect of the present invention is to provide a method for producing an individualized strip for packaging purposes, with which decorative or identification elements can be reliably embossed into the strip without additional production steps being required, for example at the producer of the packaging means.

According to a first teaching of the present invention, the above disclosed aspect is achieved in that decorative or other identification elements are embossed into the strip during the last rolling pass of cold rolling and in that the strip thickness is greater in the area of the decorative and identification elements than in the remaining areas of the strip.

In contrast to the method known from the prior art, the strip areas which are not to be embossed by the identification element or the company logo are therefore more greatly reduced in thickness than the areas to be embossed, so that these have a greater strip thickness. As a result of this, the embossing step can be incorporated into a finishing roll step and the method step for embossing the identification elements or, respectively, logos can, at the same time, be combined with an increased degree of deformation. The method according to the invention ensures that a reliable process for embossing the decorative or identification elements is carried out without greater difficulties arising from setting the work rolls in the fabrication process.

Preferably, at least one of the work rolls used during cold rolling has depressions for embossing the decorative or identification elements into the strip, so that in the roll gap the material of the rolled strip flows into the depressions and consequently produces areas of increased strip thickness. The amplitude of the embossing profile in the strip is at most 4 μm due to the depressions in the work roll. The depressions in the work roll are preferably laser textured. Other methods for creating the depressions in the roll can also, however, be used. Furthermore, it is also possible for both work rolls to have corresponding depressions, it is only essential that the strip areas which do not have any decorative or identification elements are more greatly reduced in thickness than the remaining areas which have the decorative or identification elements.

A particularly cost-effective exemplary embodiment of the method according to the invention can be provided by embossing the decorative or identification elements in-line with the production of the strip, for example for packing purposes. In-line in this case means that a production line for producing unembossed strips is used and at least one work roll of the last cold rolling pass is replaced by a work roll having decorative or identification elements as depressions and this work roll embosses the decorative or identification elements into the strip for packaging purposes.

According to a subsequent exemplary embodiment of the method according to the invention, after finish-rolling the strip is wound onto a coil, so that a strip having decorative or identification elements can be conveyed to the further production steps, for example production steps for producing a can lid or a can closure.

The decorative or identification elements can be particularly reliably introduced into the strip by the reduction per pass during the embossing rolling pass being between 20% and 40%. It was discovered that the strip can be embossed even at these reductions per pass and can lead to particularly good and clean embossing results.

According to another embodiment of the method according to the invention, the work rolls of the embossing roll pair have different grinding structures. This is particularly advantageous if depressions for embossing the decorative or identification elements are only provided in one work roll.

Very good embossing results were, according to another embodiment of the method according to the invention, in particular obtained by carrying out the last embossing roll pass in a sexto roll stand.

Preferably, the final strip thickness is 0.15 mm to 0.5 mm, preferably 0.2 mm to 0.35 mm. This final strip thickness is particularly preferred for producing packages, for example cans, can lids or can closures. The strip can, however, also be used for other purposes and also for other packages.

The strip particularly preferably consists of a 5xxx aluminum alloy which, in addition to very good deformability behavior, also attains very high strength values. It is, however, also possible to produce strips from other aluminum alloys with the method according to the invention, for example from type 1xxx, 3xxx or even 8xxx aluminum alloys.

According to a second teaching of the present invention, the above disclosed aspect is achieved by a strip produced according to the method according to the invention, wherein the strip comprises embossed decorative and identification elements and the strip thickness is greater in the area of the decorative or identification elements than in the remaining areas of the strip.

The strip according to the invention is individualized by the embossed decorative or identification elements without additional costs, for example due to another production step, accruing.

BRIEF DESCRIPTION OF THE DRAWINGS

There are many ways of enhancing and further developing the method according to the invention and the strip according to the invention. For this purpose, reference is made, on the one hand, to the claims and to the description of an exemplary embodiment in conjunction with the drawing. The drawing shows in FIG. 1 a schematic view of a finishing roll train for carrying out the method according to the invention for producing an aluminum strip for packaging purposes, FIG. 2 a work roll pair of the finishing roll stand from FIG. 1 and FIG. 3 in a schematic, sectional view, an exemplary embodiment of a strip according to the invention for packaging purposes.

DESCRIPTION

Figure 1:
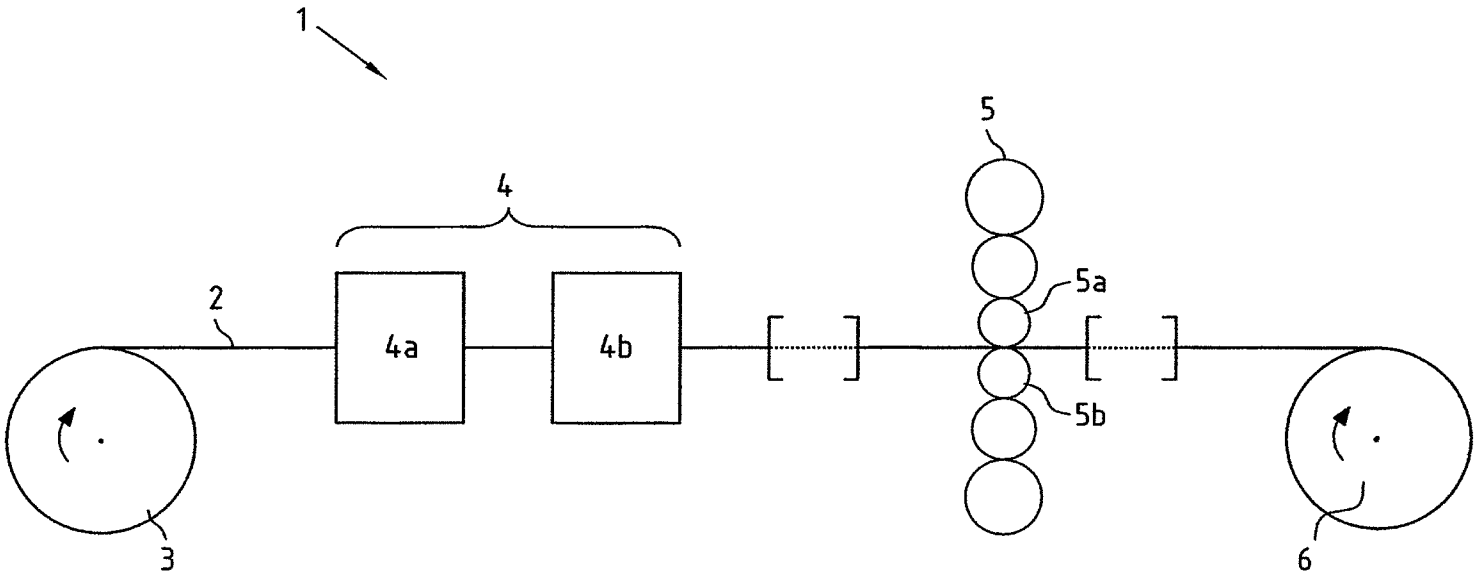

FIG. 1 shows an exemplary embodiment of a finishing roll train 1 for cold rolling an aluminum strip 2 which has been produced, for example, by hot rolling a slab. The aluminum strip 2 is uncoiled from a decoiler 3 and conveyed to further processing steps 4. The further production steps can, for example, consist of cold rolling and intermediate annealing as a strip. They are, however, not necessary to implement the present invention. The production steps 4 can, therefore, also be omitted, provided, for example, that the strip is intermediately annealed in batches, i.e. intermediately annealed while being wound on a coil, and then conveyed to the last rolling pass.

In the last rolling pass in a sexto roll stand 5, the strip is rolled to the final thickness, wherein preferably the reduction per pass is between 20 to 40%. In the present exemplary embodiment, the work roll 5*a* has depressions for embossing decorative or other identification elements, which during the final rolling pass causes areas with an increased strip thickness to be introduced, namely the areas of the decorative or identification elements. Of course, instead of the sexto roll stand, it is also possible for other roll stands to be employed. Up to now, however, good embossing results have only been confirmed on a sexto roll stand.

The aluminum strip rolled to the final thickness in such a way is then wound onto a coiler 6. However, before winding, yet more production steps, for example surface treatment, can be carried out. The final thickness of the aluminum strip in the present exemplary embodiment is 0.2 mm to 0.35 mm. By the use of the aluminum alloy, preferably a type 5xxx aluminum alloy, a particularly high strength for the aluminum strip and, at the same time, good deformability thereof during further processing is possible even with the narrow wall thicknesses.

By individualizing the aluminum strip with the method according to the invention, the secondary producer is able to identify the products produced from it without having to resort to other technologies, for example additional imprinting or the like. All additional production steps increase the production costs which are very important with these products.

Figure 2:
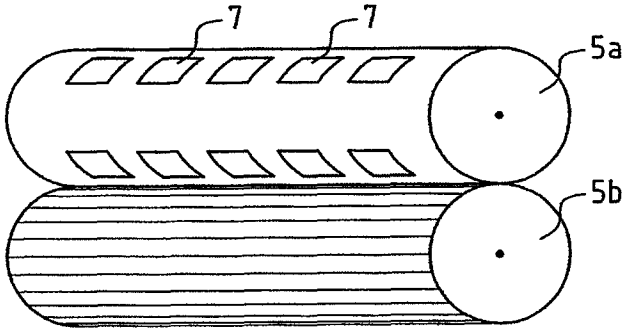
Figure 3:
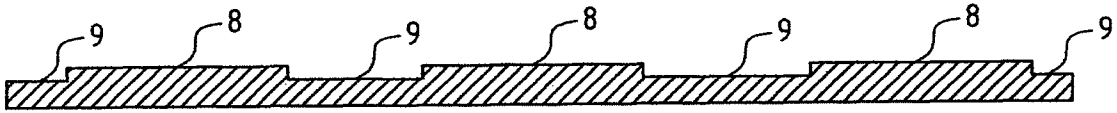

In FIG. 2, the work roll pair 5*a*, 5*b*, used in the sexto roll stand illustrated in FIG. 1, is illustrated schematically in a perspective view. Whilst the work roll 5*a* has depressions 7, which are used to emboss decorative or identification elements into the aluminum strip, no depressions are provided on the work roll 5*b*. The strip produced in such a way therefore has decorative or identification elements which in one direction out of the plane of the strip have a greater strip thickness than the remaining strip areas. Both work rolls 5*a*, 5*b* have different grinding structures to optimize the flow of material into the depressions when the strip is finish-rolled, so that the flow of the aluminum material into the depressions of the work roll 5*a* in the roll gap is supported during finish-rolling. However, it is also possible for both work rolls 5*a* and 5*b* to have depressions for embossing decorative or identification elements.

As a result, at the end of finish-rolling, an aluminum strip 2 for packaging purposes is wound onto a coil, which was not so greatly reduced in thickness in the area of the decorative elements 8 and in this respect has a greater strip thickness than in the remaining areas 9 of the strip which were not provided with decorative or identification elements. A maximum embossing profile of 4 μm results from this.

The invention claimed is:

1. Method for producing a strip consisting of aluminum or an aluminum alloy for packaging purposes, the method comprising embossing decorative or other identification elements into the strip during a last rolling pass of cold rolling, the strip thickness is greater in an area of the decorative or identification elements than in remaining areas of the strip and an amplitude of an embossing profile in the strip is at most 4 μm.

2. Method according to claim 1, wherein at least one of work rolls used during cold rolling has depressions for embossing the decorative or identification elements into the strip.

3. Method according to claim 1, wherein the decorative or identification elements are embossed in-line with production of the strip for packaging purposes.

4. Method according to claim 1, wherein after finish-rolling the strip is wound onto a coil.

5. Method according to claim 1, wherein reduction per pass during the embossing rolling pass is between 20% and 40%.

6. Method according to claim 1, wherein work rolls of an embossing roll pair have different grinding structures.

7. Method according to claim 1, wherein a last, embossing rolling pass is carried out in a sexto roll stand.

8. Method according to claim 1, wherein a final strip thickness is 0.15 mm to 0.5 mm.

9. Method according to claim 1, the strip consists of a 5xxx aluminum alloy.

10. Strip according to claim 1, consisting of aluminum or an aluminum alloy, the strip comprising embossed decorative or identification elements and having a strip thickness greater in an area of the decorative or identification elements than in remaining areas of the strip, wherein an amplitude of an embossing profile in the strip is at most 4 μm.

* * * * *